US006178789B1

(12) United States Patent
Finkelstein et al.

(10) Patent No.: US 6,178,789 B1
(45) Date of Patent: Jan. 30, 2001

(54) CONVERTIBLE CYLINDER LOCK

(75) Inventors: Burl Finkelstein; Stevie C. Roop, both of Newnan, GA (US)

(73) Assignee: Kason Industries, Inc., Shenandoah, GA (US)

( * ) Notice: Under 35 U.S.C. 154(b), the term of this patent shall be extended for 0 days.

(21) Appl. No.: 09/281,184

(22) Filed: Mar. 30, 1999

(51) Int. Cl.[7] ..... E05B 13/10

(52) U.S. Cl. ..... 70/210; 70/215; 70/224; 70/360; 70/371; 70/462

(58) Field of Search ..... 70/215, 224, 371, 70/81, 100, 372, 374, DIG. 20, DIG. 27, DIG. 31, 462, 210, 360, 361, 370; 292/244

(56) References Cited

U.S. PATENT DOCUMENTS

| | | | | |
|---|---|---|---|---|
| 3,744,283 | * | 7/1973 | Schmidt | 70/141 X |
| 4,484,462 | * | 11/1984 | Berkowitz | 70/224 X |
| 4,553,415 | * | 11/1985 | Maffey | 70/360 X |
| 4,565,080 | * | 1/1986 | Kincaid et al. | 70/224 X |
| 4,697,444 | * | 10/1987 | Maffey | 70/361 X |
| 4,991,414 | * | 2/1991 | Moore et al. | 70/360 X |
| 5,634,357 | * | 6/1997 | Nutter et al. | 70/210 |

FOREIGN PATENT DOCUMENTS

| | | | | |
|---|---|---|---|---|
| 1915618 | * | 10/1970 | (DE) | 70/360 |
| 1528245 | * | 4/1968 | (FR) | 70/224 |
| 2040344 | * | 8/1980 | (GB) | 70/215 |
| 2172331 | * | 9/1986 | (GB) | 70/371 |
| 2219035 | * | 11/1989 | (GB) | 292/DIG. 62 |
| 2263304 | * | 7/1993 | (GB) | 70/224 |
| WO 90/06412 | * | 6/1990 | (WO) | 70/224 |

OTHER PUBLICATIONS

Kason Catalog 6, p. 106, Kason 4001 locking handle.
Kason Catalog 6, p. 110, Kason 4168 locking handle.
Illinois Locks Catalog, p. 19, Illinois Lock D6714 locking cylinder.
Illinois Locks Catalog, p. 19, Illinois Lock D8714 locking cylinder.
Chicago Lock Co. Catalog, 3–7, Chicago 180–4255 Handle cylinder.

* cited by examiner

*Primary Examiner*—Lloyd A. Gall
(74) *Attorney, Agent, or Firm*—Kennedy, Davis & Hodge, LLP

(57) ABSTRACT

A convertible cylinder lock handle comprises a hub, a handle extending from the hub, and a drive shaft extending from the hub along an axis of handle rotation. The hub has a channel sized to receive a lock cylinder and a slot that extends along and spacially communicates with the channel sized to receive a spring loaded lock cylinder bolt. The lock handle also has a bolt lock plate sized to be received in reversible orientations within the slot that has two stops spaced apart a distance to receive and entrap the cylinder bolt therebetween. One of the stops has a ramp for camming engagement with the spring loaded cylinder bolt whereby in one lock plate orientation the bolt is locked out of the lock plate and in its reversed orientation the lock plate receives and entraps the bolt. The handle is particularly suited for use on delivery van type vehicles as it is fully compatible with existing lock cylinders that may be removed with spanner tools without having to disassemble the handle. This enables van fleet users and body manufacturers to determine key numbers after the handles have been installed.

10 Claims, 4 Drawing Sheets

CONVERTIBLE CYLINDER LOCK

TECHNICAL FIELD

This invention relates generally to cylinder locks and particularly to cylinder lock handles used with door latches such as those on delivery vans.

BACKGROUND OF THE INVENTION

Key operated cylinder locks have long been used for locking doors, file cabinet drawers and the like. Prevalent among such is their use in locking the doors of panel trucks and vans. These vehicles ordinarily have both a sliding side door as well as a hinged rear door. Both doors are latched and unlatched by rotatable handles. For security these handles are equipped with key operated lock cylinders. In some cases a stationary lock cylinder is used which means that the cylinder is not depressible but remains fixed along its axis in both its locked and unlocked positions. To lock or unlock a stationary cylinder lock a conventional metallic key is simply inserted into it and rotated. Nevertheless both locking and unlocking of the doors require use of a key. This is a desirable feature in that the door cannot be closed and locked accidently. On the other hand a push-to-lock type cylinder, which does having limited axial movement, can be more readily locked since it does not require a key. One merely pushes it in to lock. Thus some customers, such as van fleet purchasers, may prefer one or the other for both the side and rear door while others may prefer one type for one door and another type cylinder lock for the other door. The van body manufacturer thus needs the flexibility of being able to install the door latch and handle during body manufacture with the ability to install the desired key coded cylinder lock later in the field.

To meet this goal Kason Industries, Inc. has recently produced two door handles with factory keyed cylinder locks of both the stationary and the push type. However, it would be more effective if a single handle and cylinder assembly that could be readily converted to either stationary or push operation in the field were to be devised with the ability to field select key codes (cylinder number). It is to this end that the present invention is primarily directed.

SUMMARY OF THE INVENTION

Briefly described, a convertible cylinder lock comprises a housing having a channel sized to receive a lock cylinder and a slot that extends along and spacially communicates with the channel that is sized to receive a spring loaded lock cylinder bolt. A lock cylinder with spring biased lock bolt is mounted in the channel. The lock also has a bolt lock plate that is sized to be received in reversible orientations within the slot. This plate has two stops spaced apart a distance to receive and entrap the cylinder bolt therebetween. One of the plate stops has a ramp for camming engagement with the spring loaded cylinder bolt whereby in one lock plate orientation the bolt is locked out of the lock plate and in its reversed orientation the lock plate receives and entraps the bolt. Preferably the lock is of a pop out design with the housing channel having a ramp to cam the bolt to an unlocked position upon rotation of the cylinder.

DETAILED DESCRIPTION

Figure 1:
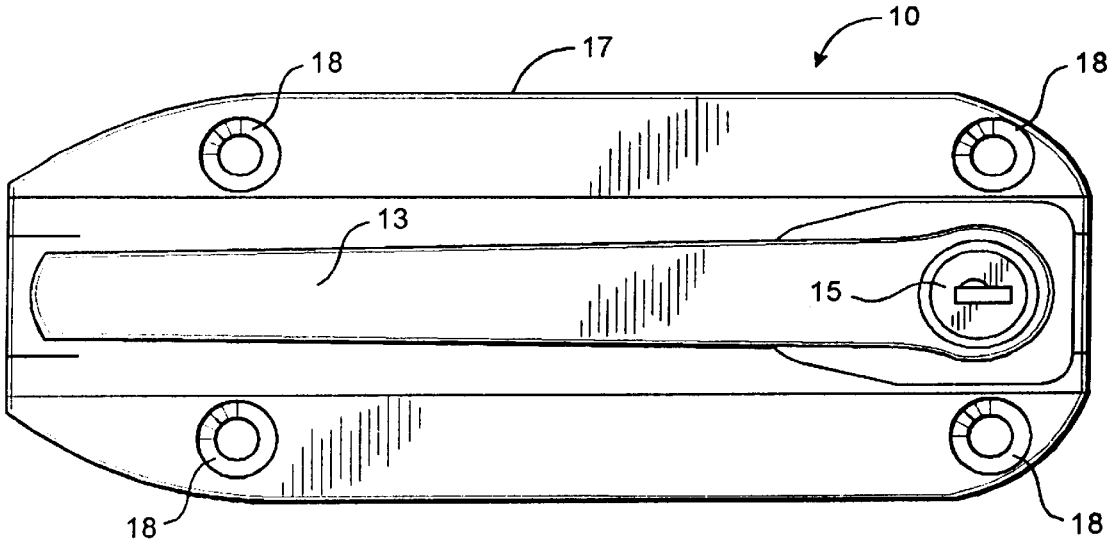
FIG. 1 is a face view of a key cylinder lock and handle that embodies the invention in its preferred form.
Figure 2:
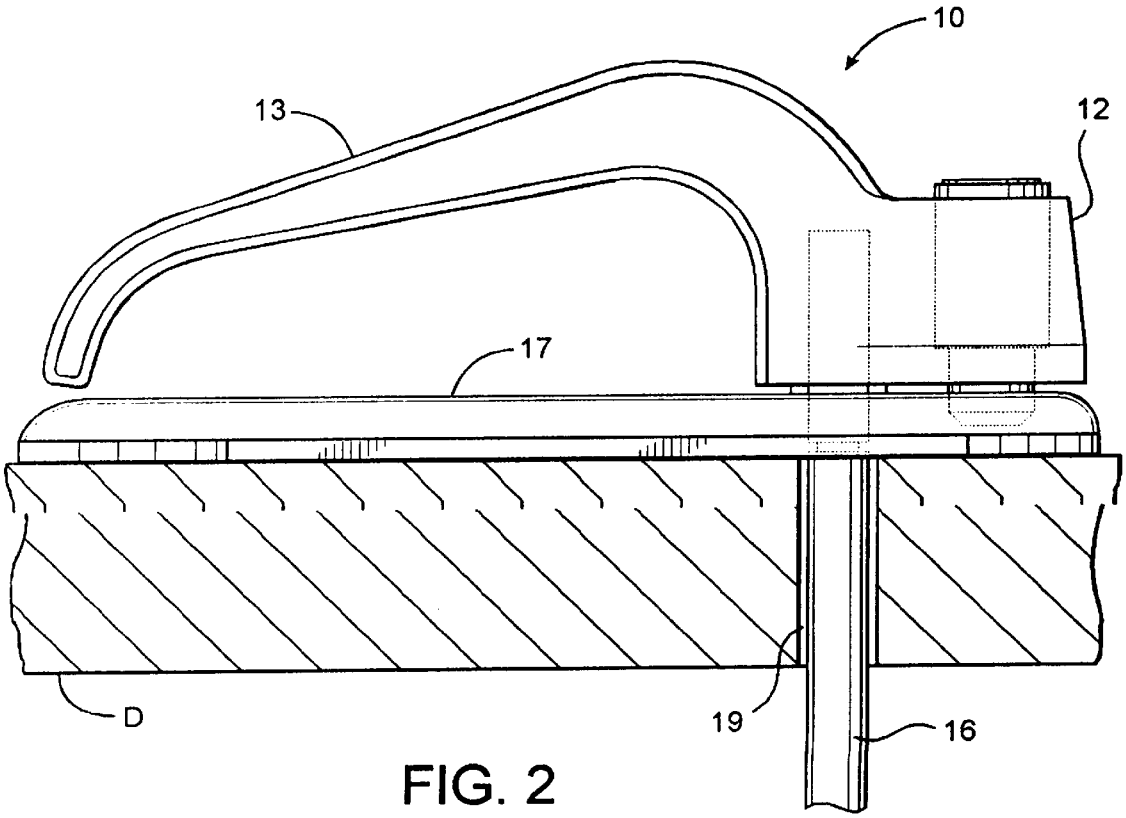
FIG. 2 is a side view of the key cylinder lock of FIG. 2 shown mounted on a door.
Figure 3:
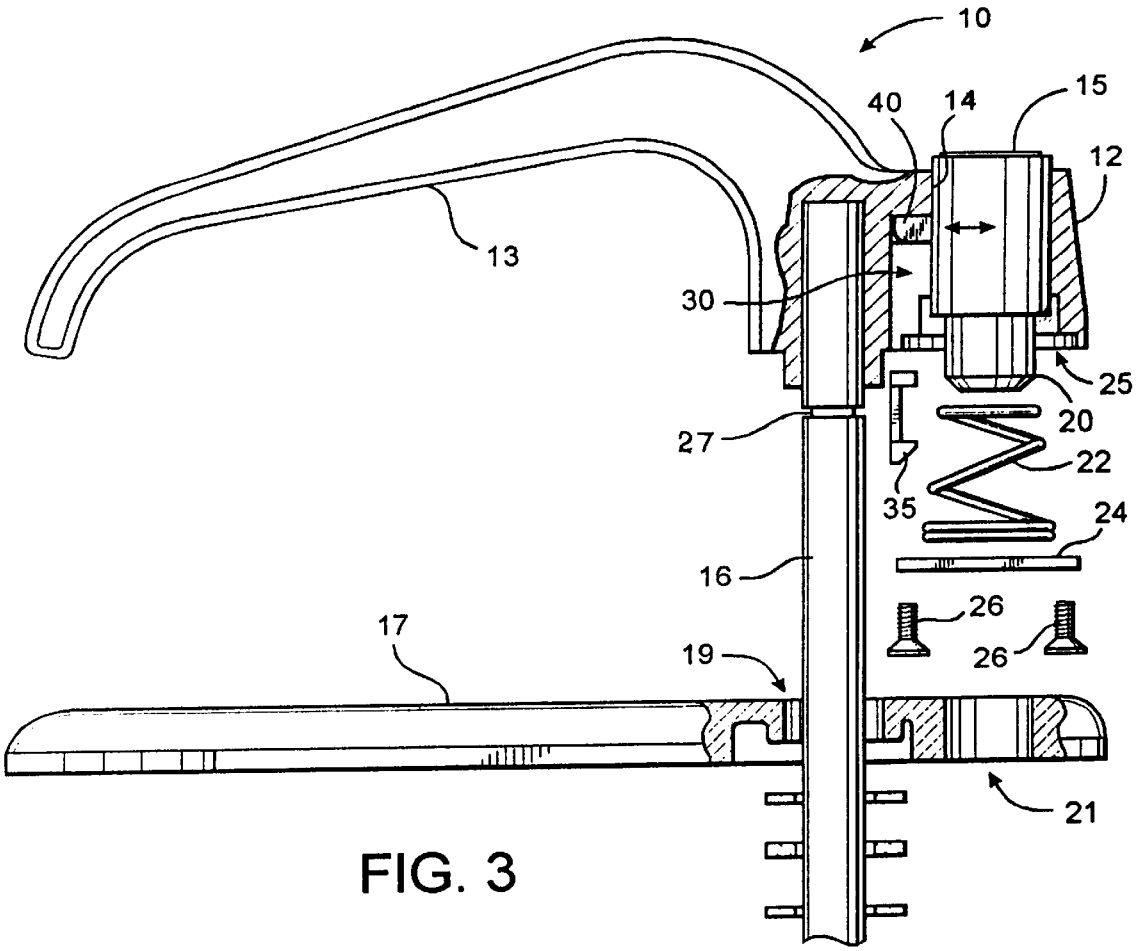
FIG. 3 is an exploded view of the key cylinder lock and handle assembly.

Referring now in more detail to the drawing, there is shown a key lock cylinder and handle assembly 10 having a hub 12 from which a handle 13 extends. The hub has a cylindrical channel 14 in which a conventional key lock cylinder 15 is mounted. A drive shaft 16, that is square in cross section, is rigidly mounted to the hub 12 parallel to the lock cylinder 15. Once the lock cylinder assembly is mounted to a door D the drive shaft extends through the door and is coupled to an unshown latch in a conventional manner such that rotation of the drive shaft latches and unlatches the door.

The assembly further includes a mounting or escutcheon plate 17 that is mounted flushly to the door D by unshown screws passed through screw holes 18. The drive shaft extends through a channel 19 in the mounting plate. A bolt portion 20 of the lock cylinder 15 also extends into another channel 21 in the mounting plate when the door is locked by the cylinder lock. A compression spring 22 is mounted in an enlarged lower portion of the hub channel 14 to spring bias the lock cylinder 15 away from the door D and mounting plate 17. It is held in place within the hub by a back plate 24 mounted within a hub recess 25 by screws 26. The handle and hub itself are rotatably held to the mounting plate 17 by an unshown snap ring type retainer that snaps into a groove 27 in the drive shaft 16.

Figure 7:
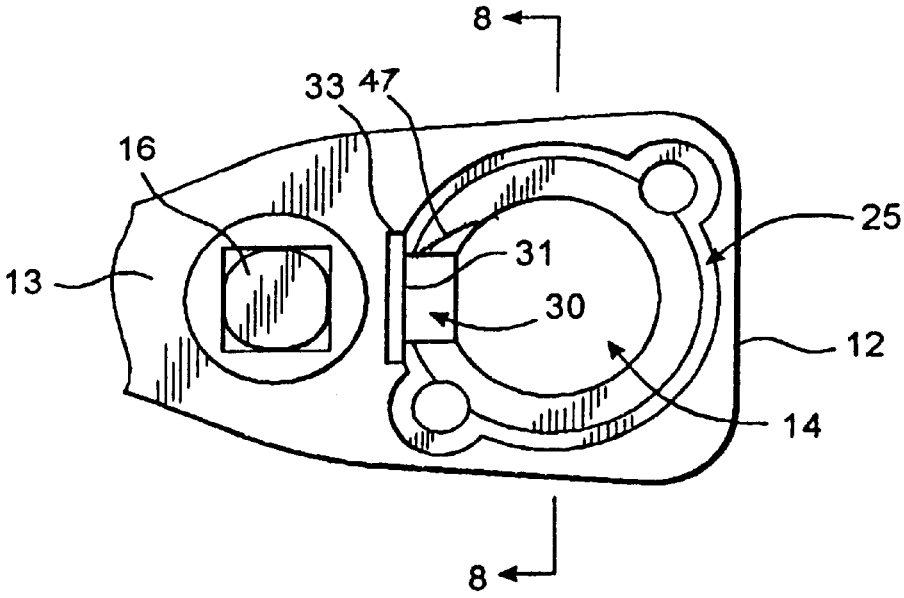
FIG. 7 is a face view of the handle hub showing the hub cylinder lock receiving channel.
Figure 8:
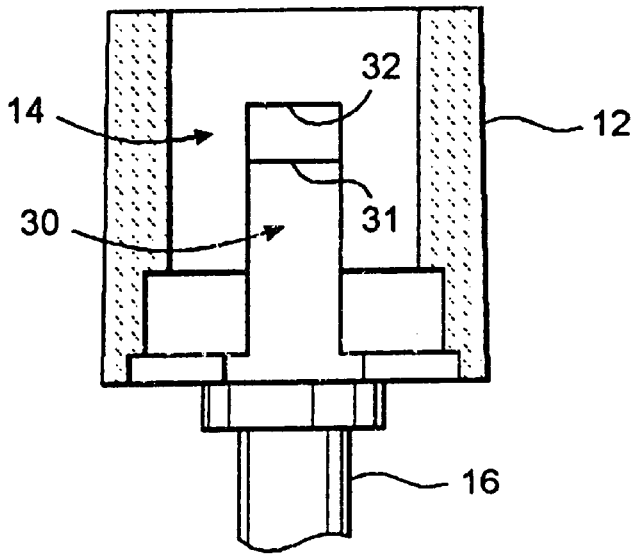
FIG. 8 is a cross sectional view of the hub shown in FIG. 7 taken along plane 8—8.

The hub 12, which functions as the mounting for the cylinder lock, also has a slot 30 that extends along one side of the channel 14 in spacial communication with it. As shown in FIG. 7 the slot is T-shaped in cross section until it reaches a step 31. From the step 31 to the slot end wall 32, it is rectangular in section. The slot has a cross arm portion 33 from which a leg extends right angularly to the channel 14.

Figure 4:
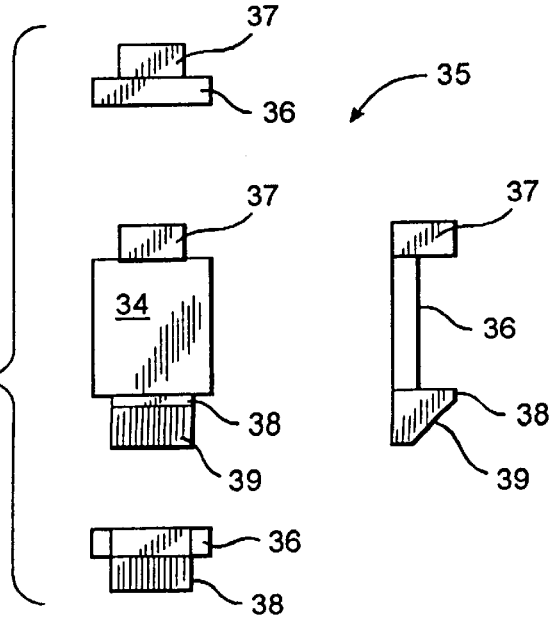
FIG. 4 is a composite of different enlarged views of the bolt lock plate component of the assembly shown in FIG. 3.
Figure 5:
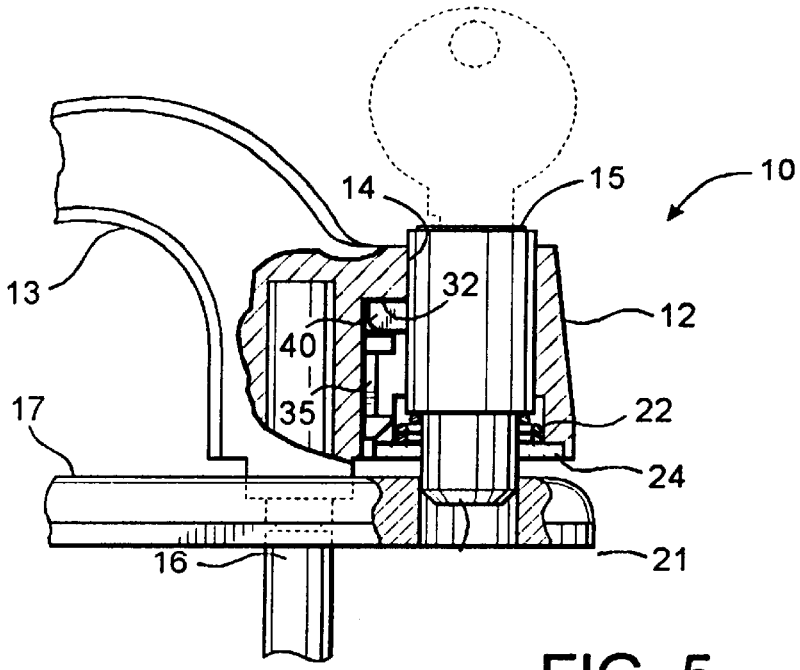
FIG. 5 is a view, partly in section, of the key lock cylinder and handle configured for stationary lock cylinder operation.

An important feature of the assembly is the inclusion of the bolt lock plate 35 shown in four views in FIG. 4. It has a flat plate 36 that is straddled by two stops 37 and 38. The stop 37 is squared off. The other stop 38 however has a sloping ramp 39. The span of the plate 36 between the two stops is sized to receive the spring biased bolt 40 of the cylinder lock 15. The spacing between the end wall 37 of the lock plate 35 and end wall 32 is also sized to receive the cylinder bolt 40. With the lock plate slid into the T-shaped slot in the orientation shown in FIG. 5 up against step 31, the cylinder lock bolt is received in the space between the bolt lock plate stop 37 and slot end wall. The lock cylinder 15 thus cannot be pushed down into the hub further because its bolt strikes and is stopped by the stop 37. However, if the bolt lock plate is slid into the slot in a reversed orientation, then its stop 38 occupies the position of the stop 37 shown in FIG. 5. With its ramp 39 now facing the slot end wall, the spring biased cylinder bolt will be depressed as shown by the double headed arrow and ride up the ramp and into the space between the two stops 37 and 38 to become entrapped here.

Figure 6:
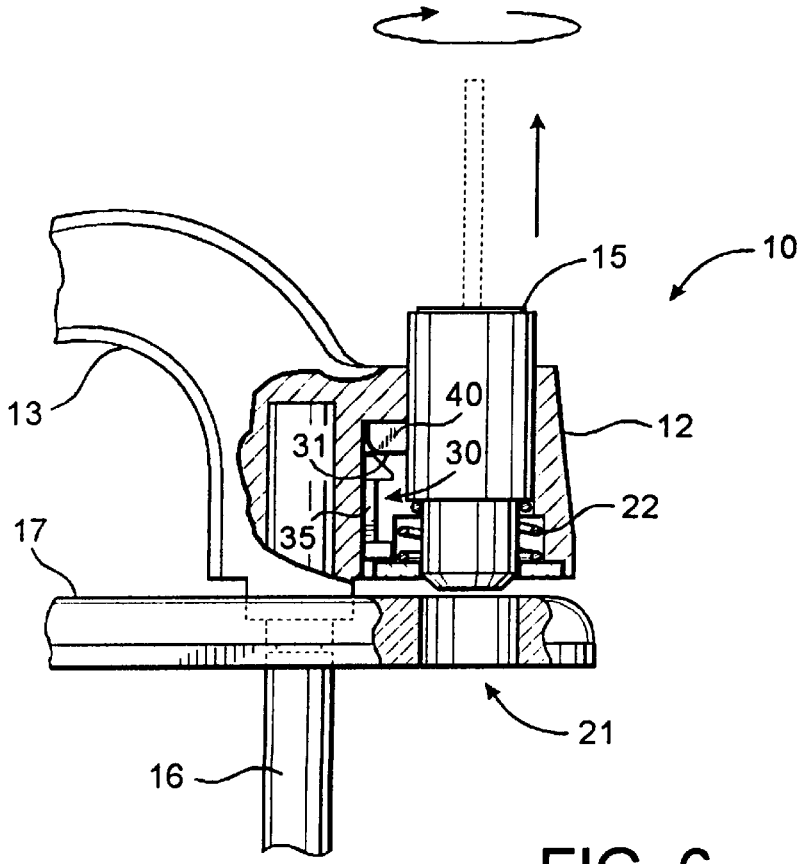
FIG. 6 is a view, partly in section, of the key lock cylinder and handle configured for push lock cylinder operation.

The orientation of the bolt lock plate 35 may be reversed by unscrewing and lifting the mounting plate 17 from the door and then freeing the hub 12 from the plate by unsnapping the unshown snap ring from the drive shaft 16. The back plate 24 is then unscrewed from the hub whereupon the bolt lock plate 35 may fall free out of the hub slot. It then may be inverted and slid back into the slot and the components reassembled in reverse order from that just described. In the field however the plate may be more readily reversed simply by turning the lock cylinder key fully clockwise to its unlocked position and fully depressing the cylinder. As indicated in broken lines in FIG. 6, a spanner tool is then used to engage two unshown notches in the cylinder face and turns the face clockwise. This cams in the lock bolt upon spiral ramp 47 whereupon the lock cylinder may be pulled out of the hub by the key to render the lock plate 35 accessible. Full reassembly is done in reverse order.

It thus is seen that a cylinder lock assembly is now provided that may be readily convertible between stationary and push type lock operations. Moreover, this is fully compatible with existing pop out lock cylinders that may be removed with spanner tools without having to disassemble the handle. Thus delivery van fleet users and van body manufacturers may readily determine key numbers after the handles have been installed.

Though it has been shown and described in its preferred form, it should be understood that many modifications, additions and deletions may be made to the invention without departure from its spirit and scope as set forth in the following claims.

What is claimed is:

1. A convertible cylinder lock comprising a housing having a channel sized to receive a lock cylinder and a slot that extends along and spacially communicates with said channel sized to receive a spring loaded lock cylinder bolt, a lock cylinder with spring biased lock bolt mounted in said housing channel, and a bolt lock plate sized to be received in reversible orientations within said slot and which has two stops spaced apart a distance to receive and entrap the cylinder bolt therebetween with one of said stops having a ramp for camming engagement with the spring loaded cylinder bolt whereby in one lock plate orientation the bolt is locked out of the lock plate and in its reversed orientation the lock plate receives and entraps the bolt.

2. The convertible cylinder lock of claim 1 wherein said slot is T-shaped in cross section and has a cross arm portion from which a leg portion extends, and wherein said lock plate has a flat plate of a width to be slidably received in said slot cross arm portion.

3. The convertible cylinder lock of claim 2 wherein said slot leg portion spacially communicates with said hub channel and has a step against which said bolt lock plate abuts.

4. The convertible cylinder lock of claim 3 wherein said slot has an end wall spaced from said step a distance to receive the cylinder bolt therebetween.

5. A convertible cylinder lock handle having a channel sized to receive a lock cylinder and a slot in spacial communication with said channel, and means insertable into said handle slot for preventing substantial axial movement of a cylinder mounted within said channel in one slot mounted orientation and for permitting limited cylinder axial movement of the cylinder in another slot mounted orientation, said means comprising a bolt lock plate that has two stops spaced apart a distance to receive and entrap a spring biased bolt of the lock cylinder therebetween with one of said stops having a ramped surface facing away from the other stop over which the cylinder bolt may be cammed.

6. A convertible cylinder lock handle comprising a hub, a handle extending from said hub, a drive shaft extending from said hub along an axis of handle rotation, and wherein said hub has a channel sized to receive a lock cylinder and a slot that extends along and spacially communicates with said channel sized to receive a spring loaded lock cylinder bolt, and a bolt lock plate sized to be received in reversible orientations within said slot which has two stops spaced apart a distance to receive and entrap the cylinder bolt therebetween with one of said stops having a ramp for camming engagement with the spring loaded cylinder bolt, whereby in one lock plate orientation the bolt is locked out of the lock plate and in its reversed orientation the lock plate receives and entraps the bolt.

7. The convertible cylinder lock handle of claim 6 wherein said slot is T-shaped in cross section and has a cross arm portion from which a leg portion extends, and wherein said lock plate has a flat plate of a width to be slidably received in said slot cross arm portion.

8. The convertible cylinder lock handle of claim 7 wherein said slot leg portion spacially communicates with said hub channel and has a step against which said bolt lock plate abuts.

9. The convertible cylinder lock handle of claim 8 wherein said slot has an end wall spaced from said step a distance to receive the cylinder bolt therebetween.

10. A pop out cylinder lock handle convertible between stationary and push to lock configurations, and with the pop out cylinder lock handle having a hub, a handle extending from said hub, a drive shaft extending from said hub along an axis of handle rotation, and wherein said hub has a channel with a spiral ramp sized to receive a lock cylinder and a slot that extends along and spacially communicates with said channel sized to receive a spring loaded lock cylinder bolt, and a bolt lock plate sized to be received in reversible orientations within said slot which has two stops spaced apart a distance to receive and entrap the cylinder bolt therebetween with one of said stops having a stop ramp for camming engagement with the spring loaded cylinder bolt, whereby the lock cylinder may be removed from the handle hub with a spanner tool by rotating the cylinder lock in a locked condition with the hub channel ramp camming the bolt to an unlocked position and drawing the lock cylinder out with a key to expose the bolt lock plate and then reversing the orientation of the plate.

* * * * *